US005449175A

United States Patent [19]

Nagy et al.

[11] Patent Number: 5,449,175

[45] Date of Patent: Sep. 12, 1995

[54] MANIPULATIVE PUZZLE

[76] Inventors: Gyula K. Nagy, 402-5 Valhalla Drive, Winnipeg, Manitoba, Canada; Milan K. Srbecky, 414-60 Whellams Lane, Winnipeg, Manitoba, Canada, R2G 2G7

[21] Appl. No.: 126,610

[22] Filed: Sep. 27, 1993

[51] Int. Cl.[6] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 3,677,547 | 6/1972 | Hicks | 273/153 S X |
| 4,452,454 | 6/1984 | Greene | 273/153 S |
| 4,484,744 | 11/1984 | Gmünder | 273/153 S |
| 4,487,415 | 12/1984 | Wilfong | 273/153 S X |
| 4,509,756 | 4/1985 | Moscovich | 273/153 S |
| 4,949,969 | 8/1990 | Johnson | 273/153 S |
| 5,074,562 | 12/1991 | Green | 273/153 S |

*Primary Examiner*—William H. Grieb

*Attorney, Agent, or Firm*—Adrian D. Battison; Stanley G. Ade; Murray E. Thrift

[57] ABSTRACT

A puzzle of the type including three tracks arranged on a sphere in radial planes mutually at right angles and elements movable along the tracks includes the elements in the form of balls rollable along cylindrical tracks with an open area of the track surface available to grasp the balls and rotate them within the track in a row. The body is molded as an integral element with an open area inside the track thus using minimum materials and allowing the product to be molded in one piece. The balls are locked in place to prevent misalignment by a sprung retaining member which engages into the cusp between two balls in one of the tracks. The balls are arranged with different colors associated with different parts of the tracks and including a separate color for the balls at the six intersection points.

20 Claims, 3 Drawing Sheets

MANIPULATIVE PUZZLE

BACKGROUND OF THE INVENTION

This invention relates to a manipulatable puzzle for manipulation by a player of the type comprising a puzzle body defining a plurality of tracks on the puzzle body along which elements mounted on the track can move in a row, the tracks having at least one point of intersection with the other tracks so that an element on one track can move onto the others of the tracks to change the pattern therebetween.

Examples of puzzles of this type are shown in U.S. Pat. Nos. 4,452,454 (Greene); 5,074,562 (Green); and 4,484,744 (Gmunder).

In each of these arrangements the tracks are arranged on an outside surface of a sphere with the tracks lying in radial planes of the sphere mutually at right angles. This provides two points of intersection between each track and each of the other tracks giving a total of six points of intersection. The elements are in the form of tiles which lie edge to edge and slide longitudinally of the tracks. In Green and Gmunder, the tiles are formed in different colors with the spherical body having associated different colors so that the tiles can be moved into required patterns from an initial random arrangement to "solve" the puzzle.

These devices have not up till now been significantly successful on the marketplace.

SUMMARY OF THE INVENTION

It is one object of the present invention to provide an improved puzzle of the above type which allows more effective movement of the puzzle elements along the tracks.

It is a further object of the present invention to provide an improved puzzle of the above type which is constructed in a manner enabling it to be quickly and cheaply manufactured.

According to the first aspect of the invention there is provided a manipulatable puzzle for manipulation by a player comprising a puzzle body, means defining a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, each track comprising in cross section a generally C-shaped element engaging surface with an open portion of the track between edges of the element engaging surface facing outwardly and each element consisting of a spherical ball received within the C-shaped element engaging surface with a portion thereof exposed at the open portion of the track such that manipulation of the element at the open portion causes rolling of the ball along the track.

According to a second aspect of the invention there is provided a manipulatable puzzle for manipulation by a player comprising a puzzle body, means defining a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, wherein the body is hollow between the tracks.

According to third aspect of the invention there is provided a manipulatible puzzle for manipulation by a player comprising a puzzle body, means defining a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, wherein the body includes means defining for each track an associated color and wherein each track has therein a plurality of elements colored to match the associated color and wherein there are provided a plurality of intersection elements each having a color different from the colors associated with the respective tracks, the number of intersection elements being equal to the number of intersections between the tracks.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 3:
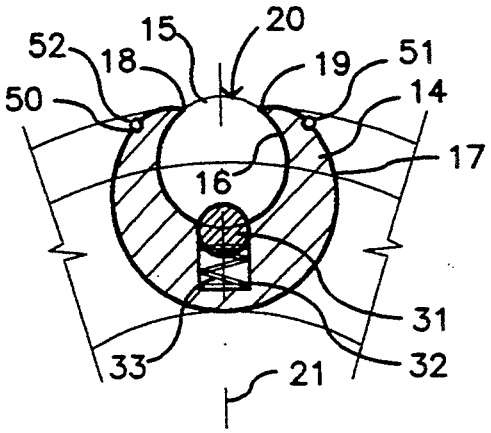
FIG. 3 is a cross sectional view along the lines 3—3 of FIG. 2.

The puzzle of the present invention is generally indicated at 10 and comprises an integral body 11 molded from plastics material. The body is molded to form a generally spherical shape defined by three tracks 12, 13 and 14 each lying in a radial plane of the spherical body with the tracks arranged mutually at right angles. Each track contains a plurality of movable elements or balls 15 contained within the track in a row along the track and movable longitudinally of the track. The tracks are identical in cross section and the cross section is shown in FIG. 3. Thus each track includes an inner surface 16 and an outer surface 17. Each of these surfaces is generally circular in cross section with the surfaces terminating at edges 18 and 19 at which the surfaces intersect. This leaves an area 20 between the edges 18 and 19 which is open at which the balls 15 are exposed. Thus the inner surface 16 is generally C-shaped extending from the edge 18 to the edge 19. Similarly the outside surface 17 is C-shaped again extending from the edge 18 to the edge 19. The centers of the circles forming these surfaces are offset so that the surface 16 is raised relative to the centre of the circle 17 so that an imaginary part of the surface 16 at the open area 20 intersects effectively with the imaginary area surface 17. This causes also the lower part of the track beneath the inner surface 16 to be of increasing thickness to a maximum at a central plane 21 longitudinally of the track.

The balls 15 have a diameter which is slightly less than the diameter of the inside surface 16 so that the balls can be received therein but can roll along the inside surface 16 rotating relative to the surface and relative to each other. Manipulation of the balls 15 is therefore effected by the fingers of the player engaging between the edges 18 and 19 and grasping the exposed portions of the balls. Rotation of the balls so grasped relative to the track will thus cause the balls in a row to move around the track.

The body is formed effectively wholly by the tracks and is hollow therebetween to define a hollow interior 25. This forms eight triangular shapes on the outside surface each between the three tracks and spaced symmetrically around the centre of the body. The body can thus be injection molded in a single integral piece and can be formed from a relatively small amount of plastics material. After molding of the body, the balls are inserted by stretching one of the tracks at a particular location therealong so as to increase the spacing between the edges 18 and 19 at that particular point along the track whereupon the balls can be pressed between the edges 18 and 19 into the track and move longitudinally of the track. All of the balls can be fed at such a stretched point and passed from each track into the next adjacent track at the intersection points. This is preferably effected after molding while the plastics material remains sufficiently warm to retain some flexibility so that the plastics material springs back to its original shape to maintain the balls wholly within the tracks without possibility of escaping.

Figure 6:
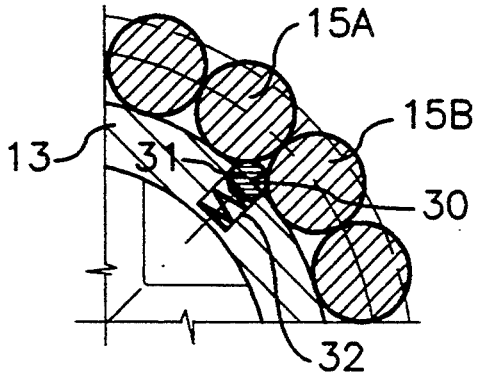
FIG. 6 is an enlarged view of the area indicated at 6 of FIG. 4.

At least one of the tracks includes a restriction member 30 acting to restrict movement of the balls in the row around the track and to locate the balls at a predetermined location in the track. In view of the rotation of the balls, the movement of the balls is relatively free and hence in the absence of the restriction member 30, the balls would tend to freely move around the track. The restriction member comprises a restriction ball 31 mounted in a cylindrical recess 32 in the base of the track so that the ball projects outwardly from the inner surface 16 into the cusp between two of the balls indicated at 15A and 15B in FIG. 6. The restriction ball 31 thus engages both of the balls 15A and 15B and holds them stationary against movement of the balls in the row around the track 13. The restriction ball 31 is spring biased into the raised position by a spring 33 which allows the restriction ball to be depressed into the cylindrical recess 32 to allow the balls 15 to move around the track. The location of the restriction ball 31 relative to the cusp between the two balls 15A and 15B is arranged so that the restriction ball tends to hold the balls 15 in the row in a position so that one of the balls of the row is located directly at the intersection between the tracks. The restriction member 30 thus acts to prevent the balls becoming misaligned relative to the intersection points. Thus holding the balls of one track at the required position relative to the track properly aligns all the four balls in that track. Each of the balls arranged at the intersection points are therefore held properly aligned with the intersection points, this alignment acts to automatically hold the balls aligned in the other two tracks. Thus it is necessary only to have one of the restriction members in one of the tracks to maintain the proper alignment. If required, however additional restriction members can be used to prevent free movement of the balls in each of the tracks.

The balls and the tracks are thus arranged side by side so that there are no spaces between the balls but merely sufficient clearance to allow the balls to rotate relative to each and relative to the track surfaces.

Figure 5:
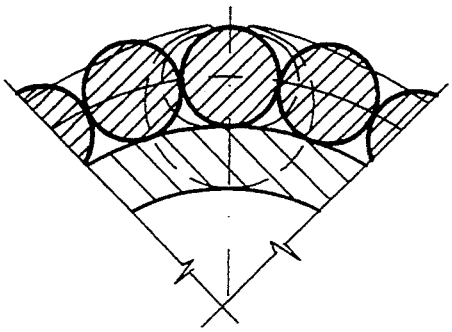
FIG. 5 is a cross sectional view along the lines 5—5S of FIG. 4.
Figure 2:
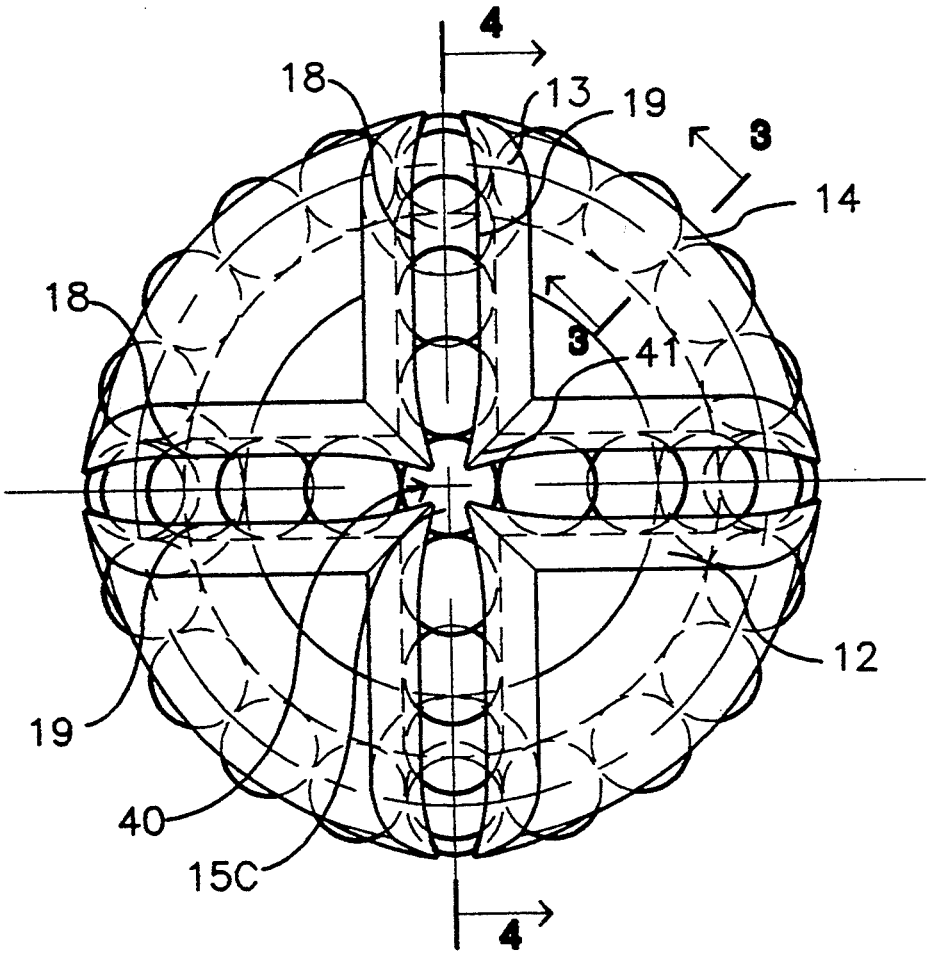
FIG. 2 is a top plan view of the puzzle of FIG. 1.

The intersection between two of the tracks is shown best in FIGS. 2 and 5. In each track the edges 18 and 19 are visible exposing a central portion of the balls 15 for grasping by the fingers of the player. Immediately on each side of the intersection shown at 40, the spacing between the edges 18 and 19 is decreased relative to the spacing therebetween at locations spaced from the intersection 40. This forms projecting points 41 at the intersection at which the edges 18 and 19 extend further over the ball 15C at the intersection. This ensures that the ball at the intersection is properly held in place by the points 41 without any possibility of the balls escaping from the intersection point away from the tracks.

Figure 4:
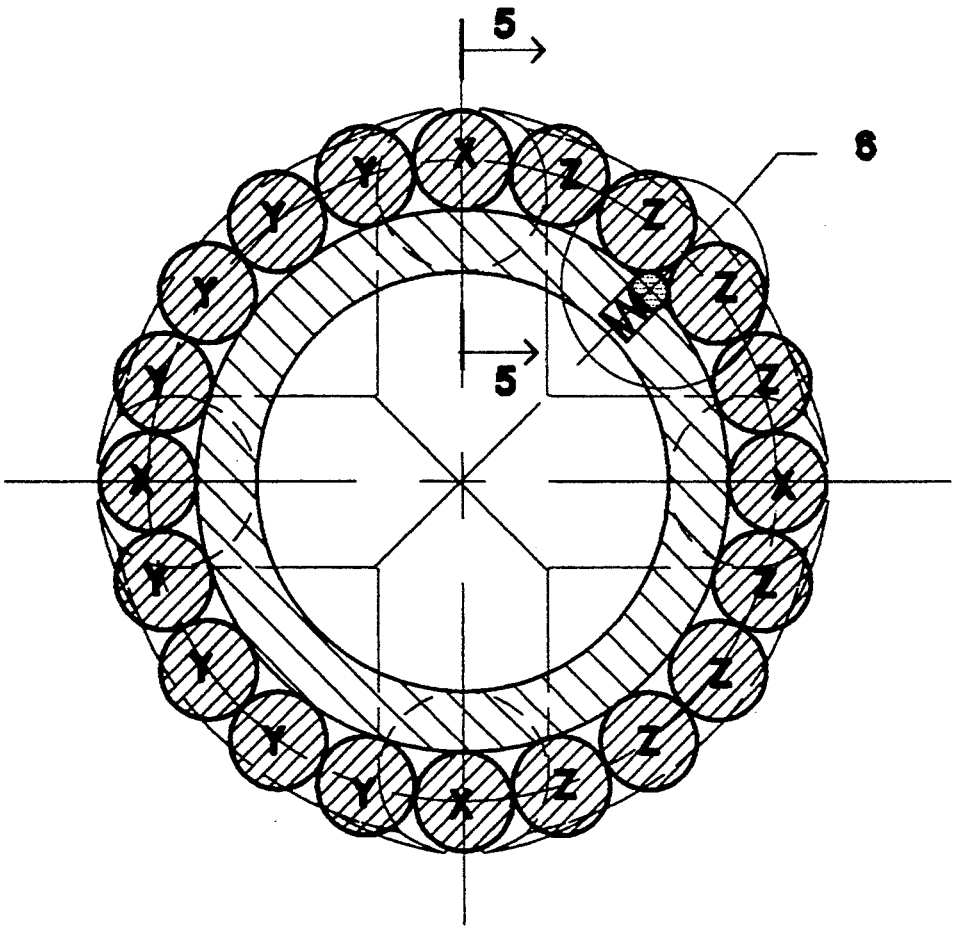
FIG. 4 is a cross sectional view along the lines 4—4 of FIG. 2.

In the example as illustrated, the diameters of the tracks are arranged relative to the diameter of the balls so that there are 20 balls around the track. However in view of the intersections this leads to a total of 54 balls, 6 of which are arranged at the six intersections. The balls in one of the tracks are shown in FIG. 4. For convenience of illustration the different colors of the balls are indicated at X, Y and Z respectively. Thus it will be noted that at each of the intersections, the balls are colored X. The remaining balls in one half of the track are colored Y and the balls in the other half of the track are Z. Each of the other two tracks includes balls which are colored with two other colors (not illustrated). There are therefore a total of seven different colors of balls. There are six X colored balls, 8 Y colored balls, 8 Z colored balls and 8 groups of balls of four additional colors.

Figure 1:
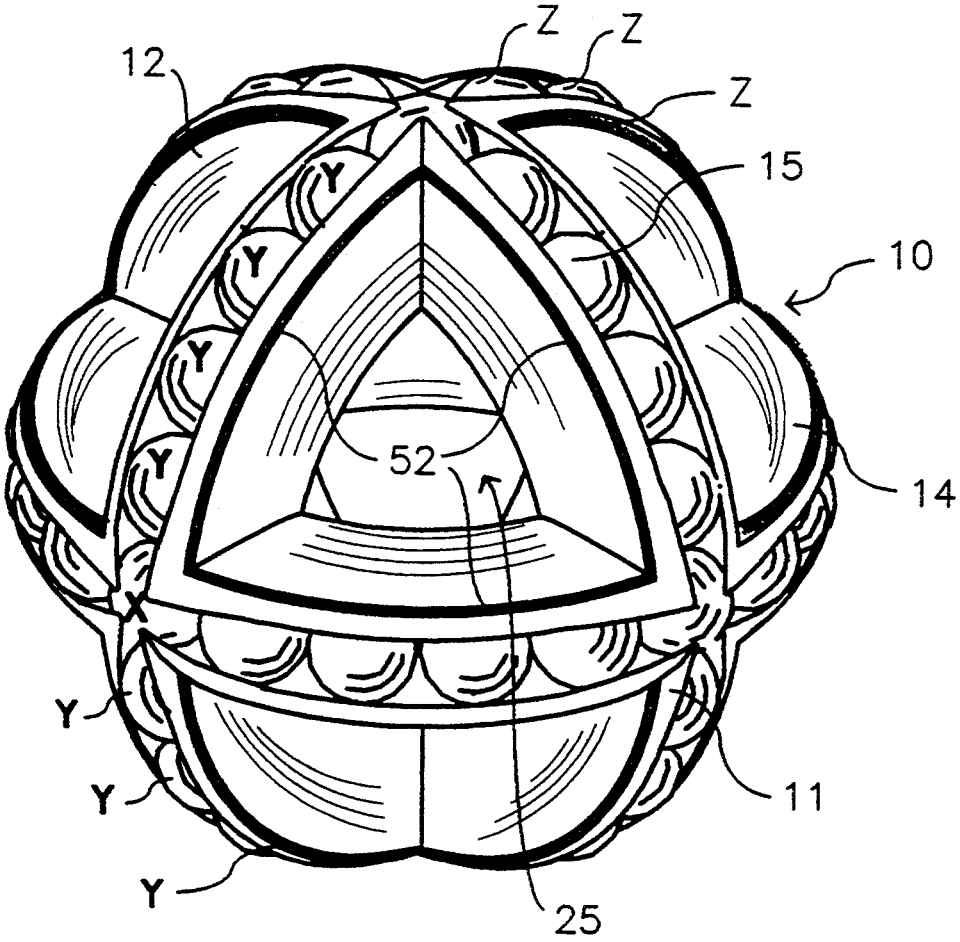
FIG. 1 is an isometric view of the puzzle according to the present invention.

Along each track on either side of the open area 20 is provided a pair of recesses 50 and 51 adjacent to but spaced slightly from the edges 18 and 19 respectively. Within each of these recesses is formed a bead 52 of a colored material which is inserted into the recess after molding of the body. Thus the body can be molded in a single color and the tracks associated with different colors by insertion of different color beads into the recesses 50 and 51. The length of each bead is equal to one quarter of the length of the track as best shown in FIG. 1.

Each track therefore has defined on it two different colors defined by selection of the required color of the bead 52. Each color extends around one half of the track, The colors are associated with respective ones of the colors of the bowls. Thus in FIG. 1, the colors X, Y and Z are visible on the balls and also on the respective ones of the beads 52.

In a finished or solved position of the puzzle, therefore, the balls are arranged with the X balls at the intersections, the Y balls properly aligned with the Y beads, the Z balls aligned with the Z beads and the remaining colored balls aligned with the remaining colored beads.

In an initial start position of the puzzle, the balls are misaligned from the finished position and the operation of the puzzle involves manipulating the balls within the tracks including changes of direction from one track to another track to move the balls to the properly aligned position or solved position.

The provision of the additional X color balls at the intersections provides a significant increased complexity of the puzzle relative to puzzles which simply require the alignment of the required colors in the tracks.

The puzzle therefore provides a simply manufactured product which provides a high level of complexity and number of possible moves prior to solution of the puzzle by proper alignment of the balls.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A manipulatable puzzle for manipulation by a player comprising a puzzle body, means defining a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, each track comprising in cross section a generally C-shaped element engaging surface with an open portion of the track between edges of the element engaging surface facing outwardly and each element consisting of a spherical ball received within the C-shaped element engaging surface with a portion thereof exposed at the open portion of the track such that manipulation of the element at the open portion causes rolling of the ball along the track.

2. The puzzle according to claim 1 including resistance means in at least one of the tracks for engaging the balls within the track to resist rotation of the row of balls around the track and to locate a point of contact between two of the balls at a predetermined location on the track.

3. The puzzle according to claim 2 wherein the resistance means comprises a member mounted in the element engaging surface and spring means biasing the member into engagement with the balls, the member being compressible against the spring means to allow movement of the balls along the track.

4. The puzzle according to claim 3 wherein the member is arranged to engage into the cusp between two balls so as to contact both of the two balls when another of the balls in the row is arranged exactly at the point of intersection of that track.

5. The puzzle according to claim 2 wherein the space between the edges of the element engaging surface is reduced immediately adjacent the point of intersection relative to the space between the edges of the element engaging surface at positions remote from the point of intersection.

6. The puzzle according to claim 1 wherein the body is hollow between the tracks.

7. The puzzle according to claim 1 wherein the body is integrally molded from plastics material.

8. The puzzle according to claim 1 wherein the body defines along a side of each track a longitudinally extending recess and wherein the recess includes a bead therealong of a colored filler material.

9. The puzzle according to claim 6 wherein the body is substantially spherical with each track lying along a radial plane of the body so as to form a circular track facing outwardly of the spherical body.

10. The puzzle according to claim 9 wherein there are three tracks arranged mutually at right angles with each track having two points of intersection with each of the other tracks.

11. The puzzle according to claim 1 wherein the body includes means defining for each track an associated color and wherein each track has therein a plurality of elements colored to match the associated color of the respective track and wherein there are provided a plurality of intersection elements each having a color different from the colors associated with the respective tracks, the number of intersection elements being equal to the number of intersections between the tracks.

12. The puzzle according to claim 11 wherein the puzzle is substantially spherical and wherein each track lies along a radial plane of the spherical body such that each track has two points of intersection with each of the other tracks.

13. The puzzle according to claim 12 wherein there are three tracks arranged mutually at right angles and wherein each track has associated therewith two different colors and includes two sets of elements each of a color matching a respective one of the two colors associated with that track and wherein there are provided six intersection elements.

14. A manipulatable puzzle for manipulation by a player comprising a puzzle body, a plurality of track means each defining a respective one of a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, each track means comprising a wall forming a channel having a channel base and channel sides for receiving the elements therein with an open slot between the channel sides for manually accessing the elements therethrough, the wall having an outside surface adjacent the elements and an inside surface facing away from the elements and inwardly of the puzzle body, wherein the body is hollow between the inside surfaces of the walls and consists essentially of the walls.

15. The puzzle according to claim 14 wherein the body is integrally molded from a plastics material.

16. The puzzle according to claim 15 wherein the body defines along a side of each track a longitudinally extending recess and wherein the recess includes a bead therealong of a colored filler material.

17. The puzzle according to claim 14 wherein the body is substantially spherical with each track lying along a radial plane of the body so as to form a circular track facing outwardly of the spherical body.

18. A manipulatible puzzle for manipulation by a player comprising a puzzle body, means defining a plurality of tracks on the puzzle body facing outwardly on the body so as to be accessible to the player, a plurality of elements mounted in each track in a row for manipulated movement along the track, each track having at least one point of intersection with at least one of the other tracks such that an element on said track can be moved onto said one of the other tracks, wherein the body includes means defining for each track an associated color and wherein each track has therein a plurality of elements colored to match the associated color and wherein there are provided a plurality of intersection elements each having a color different from the colors associated with the respective tracks, the number of intersection elements being equal to the number of intersections between the tracks.

19. The puzzle according to claim 18 wherein the puzzle is substantially spherical and wherein each track lies along a radial plane of the spherical body such that each track has two points of intersection with each of the other tracks.

20. The puzzle according to claim 19 wherein there are three tracks arranged mutually at right angles and wherein each track has associated therewith two different colors and includes two sets of elements each of a color matching a respective one of the two colors associated with that track and wherein there are provided six intersection elements.

* * * * *